US005958522A

United States Patent [19]

Nakagawa et al.

[11] Patent Number: 5,958,522

[45] Date of Patent: Sep. 28, 1999

[54] HIGH SPEED THERMAL SPRAY COATING METHOD USING COPPER-BASED LEAD BRONZE ALLOY AND ALUMINUM

[75] Inventors: Masahiro Nakagawa; Mitsumasa Sasaki; Hidetada Mima; Hiroyuki Hashimoto; Toshio Hotta; Tomoko Miyazaki, all of Tokyo, Japan

[73] Assignee: Sulzer Metco Japan Ltd., Tokyo, Japan

[21] Appl. No.: 08/914,874

[22] Filed: Aug. 18, 1997

[30] Foreign Application Priority Data

Aug. 22, 1996 [JP] Japan ..... 8-238685

[51] Int. Cl.[6] ..... C23C 4/08

[52] U.S. Cl. ..... 427/456; 427/455

[58] Field of Search ..... 427/456, 455

[56] References Cited

U.S. PATENT DOCUMENTS 4,307,998 12/1981 Nakayama et al. ..... 417/269
5,385,789 1/1995 Rangaswamy et al. ..... 428/570

FOREIGN PATENT DOCUMENTS 0 375 931 7/1990 European Pat. Off. .
713972A1 5/1996 European Pat. Off. .

OTHER PUBLICATIONS

Thermal Spraying: Practice, Theory and Application, American Welding Society, 1985 (no month date) pp. 7–9, 22,42, & 94.

Derwent Publication, Section CH, Week 7806, AN–11201 A and Japanese Publication No. 52155159 (Dec. 1977).

*Primary Examiner*—Katherine A. Bareford

*Attorney, Agent, or Firm*—Seideln, Gonda, Lavorgna & Monaco, PC

[57] ABSTRACT

A thermal spray coating method comprising producing a high speed flame from a combustion gas and spraying a thermal spray coating material powder onto the surface of a base material by using the high speed flame to form a coating on the surface of the base material. The thermal spray coating material powder is a mixed powder comprising (A) 98–70% in volume of Cu based lead bronze alloy powder and (b) 2–30% in volume of Al powder or Al based alloy powder.

17 Claims, 4 Drawing Sheets

HIGH SPEED THERMAL SPRAY COATING METHOD USING COPPER-BASED LEAD BRONZE ALLOY AND ALUMINUM

BACKGROUND OF THE INVENTION

This invention relates to a high speed thermal spray coating method comprising the steps of producing a high speed flame from a combustion gas and spraying a thermal spray coating material powder using the high speed flame onto the surface of a base material to be thermal spray coated, thus forming a coating on the surface of the base material. In particular this method is also suitable for forming a coating with improved lubricity and abrasion resistance on a part of the surface or the entire surface of a swash plate for an air compressor pump manufactured of aluminum alloy, cast iron or steel based alloy.

The swash plate of an air compressor pump, for example, is structured in such a manner that the swash plate rotates to reciprocally move a piston through shoes which are in contact with the circumferential part of both surfaces of the swash plate, and therefore the shoes slidingly move over the peripheral surfaces of the swash plate.

The swash plate is ordinarily made of aluminum alloy, cast iron or steel based alloy, whereas the sliding shoes of mating parts are formed of SUJ2 (Japanese Industrial Standards). When lubrication becomes insufficient, seizure is apt to occur. Therefore, a Sn plating or Teflon (tetrafluoroethylene resin) coating is provided on the surfaces of the swash plate, and in addition, a treatment such as a coating of $MoS_2$ (lubricant) is applied thereon.

However, in the case where the Sn-plated swash plate reaches a non-lubricant state and yet is placed under an operating condition in which the swash plate rotates with a high speed and bears a high load, the abrasion loss on the surface of the swash plate increases, eventually ending in seizure taking place between the swash plate and the shoe. Also, the Sn plating takes about 30 minutes to form a plated layer 10 $\mu$m thick. Portions of the swash plate not requiring the plating need to be masked. A lot of time is required for the coating and removing of the masking material and, as such, the Sn coating process has an inferior workability.

Similarly, when the Teflon-coated swash plate is in a non-lubricant state and is placed under an operating condition requiring a high speed rotation and a high load receiving, the abrasion loss on the swash plate surface increases. It is also necessary when performing the Teflon coating to mask the portions of the swash plate surface not requiring the coating, which takes a substantial length of time, thus making it a rather troublesome work.

At present, as far as the inventors know, there is no coating material suitable for a swash plate made of, for example, aluminum alloy, cast iron or steel based alloy, which relative to shoes made of SUJ2, exhibits satisfactory abrasion resistance, scuff resistance, seizure resistance and pressure resistance under the conditions of a high speed rotation, high load and no lubrication.

Further, there is no method for improving surface properties which is capable of easily masking portions not required to have a coating using the wet process, as well as quickly removing the mask after forming the coating and also forming the coating at a high speed.

BRIEF SUMMARY OF THE INVENTION

Therefore, one of the objects of the present invention is to provide a high speed thermal spray coating method in which the surface of the base material can be thermal spray coated with a coating which has satisfactory abrasion resistance, scuff resistance and pressure resistance under the conditions of high speed rotation, high load and non-lubrication, with a high speed and in an easy manner.

Another object of the present invention is to provide a high speed thermal spray coating method capable of forming a coating which does not peel off at the time of machining the coating, permits a sound machine finishing without voids or porosity and further, has a superior adhesion property.

Still another object of the present invention is to provide a high speed thermal spray coating method capable of forming a coating which has satisfactory lubricity and abrasion resistance, on portions of the surface or the entire surface of a swash plate, particularly for an air compressor pump made of aluminum alloy, cast iron or steel based alloy.

The objects mentioned above can be achieved by the high speed thermal spray coating method according to the present invention. In brief, the invention is a high speed thermal spray coating method comprising producing a high speed flame from a combustion gas and spraying a thermal spray coating material powder with the high speed flame onto the surface of a base material to be thermal spray coated to form a coating on the surface of the base material, wherein the thermal coating material powder is a mixed powder containing:

(A) 98–70% in volume of Cu based lead bronze alloy powder, and (B) 2–30% in volume of Al powder or Al based alloy powder.

The Cu based lead bronze alloy powder comprises Cu based lead bronze alloy containing as its components Cu=77–89% by weight, Sn=4–11% by weight, Pb=4–11% by weight and the balance being impurities of 1% or less by weight. The Al powder comprises Al containing less than 1.5% by weight of impurities. The Al based alloy powder comprises Al based alloy containing as its components Al=65–95% by weight, Si=4–30% by weight, Cu=0.5–6% by weight, and Mg=0.3–12% by weight. Preferably, the Cu based lead bronze alloy comprises Cu=77–86% by weight, Sn=6.9% by weight, and the balance being impurities of less than 1.0% by weight, while the Al based alloy powder comprises Al=65–91% by weight, Si=8–25% by weight, Cu=2–4% by weight, Mg=0.5–6% by weight, and the balance being impurities of less than 0.5% by weight.

Further, each of the Cu based lead bronze alloy powder, the Al powder and the Al based alloy powder has a particle diameter of 10–75 $\mu$m, and preferably 10–60 $\mu$m. Most preferably, the Al powder and the Al based alloy powder have a particle diameter of 10–45 $\mu$m.

According to a preferable embodiment of this invention, the base material is subjected to a grit blast treatment on the surface of the base material so as to have a surface roughness of $\mu$Rz=10–60, heated to 50–150° C., and then thermal spray coated to form a coating having a thickness of 0.2–0.5 mm on the surface of the base material. Further, the thermal spray coating is performed by using as the combustion gas any one of the mixed gases comprising oxygen/propane, oxygen/propylene, oxygen/natural gas, oxygen/ethylene, oxygen/ethylene, oxygen/kerosene and oxygen/hydrogen to generate a high speed flame having a flame speed of 1000–2500 m/second and a flame temperature of 2200–3000° C., while maintaining a thermal spray coating distance at 170–350 mm and controlling a coating temperature during thermal spray coating to 200° C. or below.

Also according to the most preferable embodiment of this invention, the coating formed on the surface of the base material is finished to have a surface roughness of Ra=0.4–6.0 S.

The thermal spray coating method of the present invention is suitably used for a thermal spray coating onto a swash plate for an air compressor pump manufactured of aluminum alloy, cast iron or steel family alloy.

DETAILED DESCRIPTION OF THE INVENTION

Figure 1:
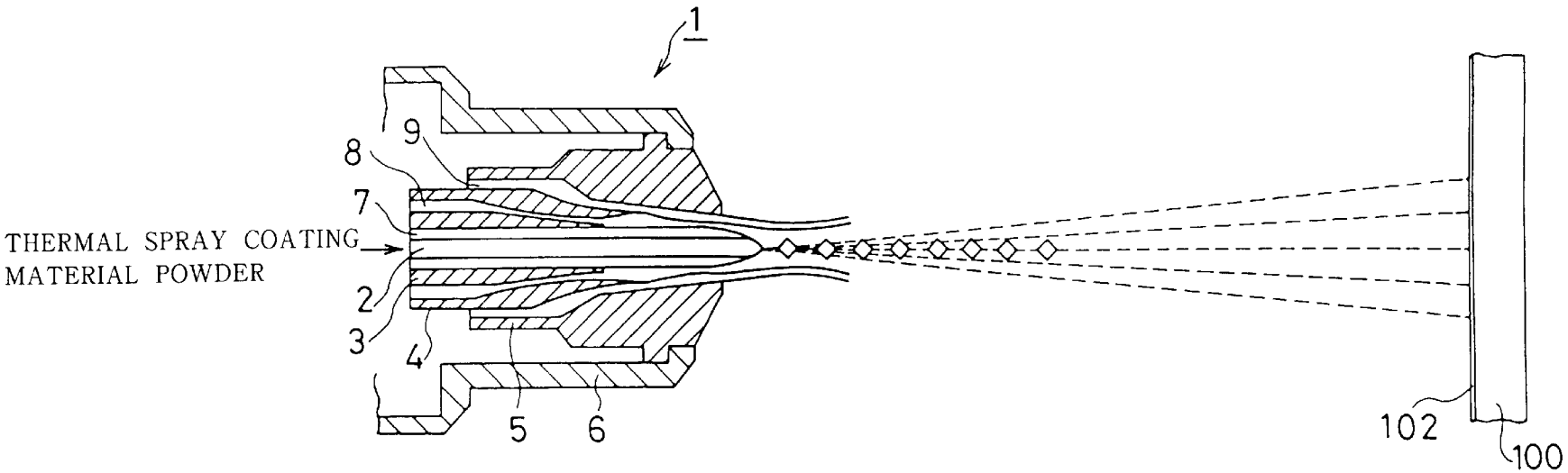
FIG. 1 is a drawing showing a schematic structure of a thermal spray coating gun for carrying out the high speed thermal spray coating method of the present invention.

A high speed thermal spray coating method according to the present invention will be explained in further detail by referring to the drawings.

A schematic configuration of a thermal spray coating device (thermal spray coating gun) 1 for performing the high speed thermal spray coating method of the present invention is shown in FIG. 1. In brief, the thermal spray coating gun 1 has a powder projection port 2 positioned at the center part of the gun for projecting thermal spray coating material powder, and a nozzle insert 3, a shell 4 and an air cap 5 positioned concentrically from interior to exterior thereof, thus forming a combustion gas passage 8 and compressed air passages 7 and 9. Further, an air cap body 6 is provided outside of the air cap 5. Since the structure of such a thermal spray coating gun 1 is known to those skilled in the art, further explanation thereof is omitted.

The thermal spray coating material powder is carried by inert gas such as nitrogen gas, supplied to the above mentioned powder projection port 2, and then injected from the tip of the port into a combustion flame. At the same time a high pressure combustion gas supplied from the combustion gas passage 8 burns at the outer periphery of the tip of the nozzle insert 3 and the shell 4. This combustion flame is encircled by compressed air and is injected under high temperature and high pressure from the air cap 5 to form a cylindrical and ultra high speed flame. The thermal spray coating material powder injected from the tip of the port 2 is heated, melted and accelerated by the ultra high speed flame at the center of the flame, so that the melted powder is blown out at high speed from the thermal spray coating gun 1. The droplets of the thermal spray coating material powder collide with a desired base material 100 which is placed at a prescribed distance, that is 170–350 mm. Thereby a thermal coating 102 is formed on the surface of the base material.

The thermal spray coating material powder used in the present invention will now be described.

In this invention, the thermal spray coating material powder is a mixed powder of Cu based lead bronze alloy powder and Al powder or Al based alloy powder. The Cu based lead bronze alloy powder contains lead which has scuff resistance but has little mating material-attack property, that is, the characteristic to attack or cause erosion/corrosion on an object it contacts, and yet has self-lubricating properties. The Al powder or Al based alloy powder is added to the Cu based lead bronze alloy powder in the volume of 2–30% and functions to restrain the oxidation of the lead at the time of thermal spray coating and to strengthen the bonding of the coating. A detailed explanation will be given with respect to this feature later.

The above mentioned Cu based lead bronze alloy powder comprises Cu based lead bronze alloy containing as its components Cu=77–89 wt %, Sn=4–11 wt %, Pb=4–11 wt % and the balance being impurities of less than 1 wt %. The impurities, such as Ni, Zn, Fe, Sb, and Si, may be exemplified. When Cu in the Cu based lead bronze alloy is less than 77 wt %, the alloy becomes brittle, and on the other hand if it exceeds 89 wt %, the scuff resistance effect of other additive metals, Sn, Pb is impaired. Therefore, the amount of Cu is set at 77–89 wt %, or preferably 77–86 wt %. Sn dissolves in Cu in the form of a solid solution and improves hardness and tensile strength. When Sn exceeds 11 wt %, the δ phase which is brittle, is apt to be produced, and on the other hand when it is less than 4 wt %, toughness decreases. Thus, the amount of Sn is set at 4–11 wt %, preferably 6–9 wt %. Also, Pb is a metal having a self-lubricating property and a distinguished scuff resistance relative to a metal matrix such as martensite and carbide in carbon steel. Pb dissolves but only slightly in a Cu—Sn alloy in the form of a solid solution and exists among primary crystal particles. When Pb is present in more than 11 wt %, the bonding strength of the thermal coating deteriorates, and on the other hand, when it is below 4 wt %, the self-lubricating property is not sufficient. Thus, the amount of Pb is set at 4–11 wt %, or preferably 6–9 wt %.

The Al powder used in the invention means aluminum in which the amount of impurities is below 1.5 wt %, that is, having a purity of 98.5% or higher. Also, the Al based alloy powder used in the invention means aluminum based alloy containing as its components Al=65–95 wt %, Si=4–30 wt %, Cu=0.5–6 wt %, Mg=0.3–12 wt % and the balance being impurities of less than 0.5 wt %. The impurities, such as Fe, Zn, and Mn, may be exemplified.

According to the results of research and experiments by the present inventors, it was found that when a thermal spray coating is performed using Cu based lead bronze alloy, namely Cu—Sn—Pb type lead bronze, Pb within the alloy reacts with oxygen in the air to form lead oxides, that is, PbO and $PbO_2$, during the thermal spray coating or forming of the coated layer, resulting in weakening of the bonding strength of the coating. Further research and experiments revealed that when Al powder which is highly susceptible to oxidation or Al based alloy powder containing Si is mixed with and added to the Cu based lead bronze alloy powder and then is used for the thermal spray coating, the oxidation of Al and Si first takes place, resulting in the restraining of the oxidation of Pb, thus reducing the amount of lead oxides such as PbO and $PbO_2$ produced and strengthening the bonding of the coating. This invention is based on such findings by the present inventors.

As further explanations on the above mentioned Al based alloy which is added to the Cu based lead bronze alloy powder, when Al is below 65 wt %, brittleness takes place, and when it exceeds 95 wt %, tensile strength is lowered. Therefore, the amount of Al is set at 65–95 wt %, or preferably 65–91 wt %. Si dissolves in Al in the form of a solid solution to improve hardness and tensile strength. However, when Si exceeds 30 wt %, a brittle phase is likely to be produced. Thus, the amount of Si is set at 30 wt % or less. On the other hand, when the amount of Si is less than 4 wt %, not much improvement of hardness and tensile strength can be expected, thus Si is set at 4–30 wt %, or preferably at 8–25 wt %. Also, Cu dissolves in Al in the form of a solid solution and enhances hardness and tensile strength. However, Cu combines itself with Al to form intermetallic compounds of θ phase ($CuAl_2$) . When Cu exceeds 6 wt %, this θ phase increases an the mechanical properties deteriorate so that the material becomes brittle. Therefore, Cu is set at 6 wt % or less. On the other hand, if Cu is less than 0.5 wt %, not much improvement in the hardness and tensile strength can be expected. Thus Cu is set at 0.5–6 wt %, or preferably 2–4 wt %. Further, Mg dissolves in Al in the form of a solid solution and improves hardness and tensile strength. However, Mg combines itself with Al to form intermetallic compounds of β phase ($Al_2Mg_2$). If Mg exceeds 12 wt %, this β phase increases and the mechanical properties deteriorate resulting in the material becoming brittle. Therefore, Mg is set at 12 wt % or less. On the other hand, when Mg is less than 0.3 wt %, not much improvement in the hardness and tensile strength can be expected. Thus, Mg is set at 0.3–12 wt %, or preferably at 0.5–6 wt %.

As explained above, the Cu based lead bronze alloy is exposed to an oxidizing atmosphere at high temperature during the thermal spray coating. Consequently, lead in the Cu based lead bronze alloy components are oxidized, or further, when the Cu based lead bronze alloy collides with the base material to be thermal spray coated and the lead is exuded and overheated, lead oxides are produced. As the lead oxides are formed on the surface of the lead, the bonding among flat particles, which are thermal spray coated to build up layers, is weakened. When 2% or more in volume of Al or preferably Al based alloy with the above mentioned composition is added to the Cu based lead bronze alloy, the formation of such lead oxides is restrained. Therefore, by the addition of Al or Al based alloy, the peel-off of Pb from the coating can be prevented at the time of machining the coating, thus permitting a sound machining and finishing without formation of voids or porosity.

As described above, when Al powder or Al based alloy powder is added to Cu based lead bronze alloy powder, the bonding strength of the coated layer increases depending on the amount added, but if the amount of Al powder or Al based alloy powder exceeds 30% in volume, a ratio of the amount of lead precipitated in the Cu based lead bronze alloy decreases and scuff resistance is lowered. Therefore, where a material is used under a sliding condition with a high load, a coating with high pressure resistance is needed, and for that end, the amount of Al powder or Al alloy powder added is set at 2–30% in volume, or preferably 3–11% in volume.

Particle diameters of the above mentioned Cu based lead bronze alloy, Al and Al based alloy in powder form used in this invention are 10–75 μm and preferably 10–60 μm. When the particle diameter exceeds 75 μm, particle temperature during the thermal spray coating becomes low, and the amount of unmelted particles increases. Therefore, the formation of a dense and fine coating becomes difficult. On the other hand, when particle diameters are smaller than 10 μm, particles melt excessively, the content of oxides in the coating increases and the coating becomes brittle. Also, the supply of the thermal spray coating material powder deteriorates and a continuous thermal spray coating becomes difficult. Therefore, the particle diameters are set as mentioned above to 10–75 μm, preferably 10–60 μm, or particularly 10–45 μm for Al powder and Al based alloy powder.

For the combustion gas used in the thermal spray coating method in this invention, any one of the mixed gases comprising oxygen/propane, oxygen/propylene, oxygen/natural gas, oxygen/ethylene, oxygen/kerosene and oxygen/hydrogen may be utilized suitably, and a flame speed increases, the speed of thermal spray coating particles also increases, and the bite of particles onto the base material at the time of colliding with the base material improves. In other words, the anchoring effect is enhanced and overall adhesion improves. Also, when the speed of particles is fast, thermal energy converted from kinetic energy at the time of collision increases, melting the uppermost surface of further enhancing base material, thus the adhesion. The flame speed necessary for securing such adhesion is 1000 m/second or faster. On the other hand, the maximum speed of flame is limited to 2500 m/second due to the structure of the present thermal spray coating gun 1 having the above mentioned configuration. Also, the flame temperature in the combustion of mixed gas mentioned above is 2200–3000° C.

For example, when a mixed gas of oxygen/propane is used as the combustion gas, the gas condition during the thermal spray coating is as follows: oxygen gas is set with a pressure of 9–13 Bar and a flow rate of 150–400 LPM (liter/minute); propane gas is set with a pressure of 5–8 Bar and a flow rate of 50–120 LPM; and compressed air is set with a pressure of 5–7 Bar and a flow rate of 250–700 LPM. Also, the ratio of flow rates between propane and oxygen gas is set such that propane:oxygen is 1:3.8–48 (as converted to the standard state), which provides the optimum combustion efficiency. When the ratio of oxygen relative to propane is below 3.8, the amount of unreacted propane increases, resulting in an increase in cost. Also, when the ratio of oxygen relative to propane exceeds 4.8, there is an excess of unreacted oxygen, resulting in oxides being produced in the coating that deteriorate the coating.

When a mixed gas of oxygen/propylene is used as the combustion gas, the gas condition during the thermal spray coating is as follows: oxygen gas is set with a pressure of 9–13 Bar and a flow rate of 150–400 LPM; propylene gas is set with a pressure of 5–8 Bar and a flow rate of 40–130 LPM; and compressed air is set with a pressure of 5–7 Ba and a flow rate of 250–700 LPM. Also, the ratio of flow rates between propylene gas and oxygen gas is set such that propylene:oxygen is 1:3.5–4.5 (as converted to the standard state), which provides the optimum combustion efficiency. When the ratio of oxygen relative to propylene is below 3.5, the amount of unreacted propylene increases, resulting in an increase in cost. Also, when the ratio of oxygen relative to propylene exceeds 4.5, the amount of unreacted oxygen increases, resulting in oxides being produced in the thermal coating that cause deterioration in properties of the coating.

When a mixed gas of oxygen/hydrogen is used as the combustion gas, the gas condition during the thermal spray coating is as follows: oxygen gas is set with a pressure of 9–13 Bar and a flow rate of 150–400 LPM; hydrogen gas is set with a pressure of 8–12 bar and a flow rate of 500–900 LPM; and compressed air is set with a pressure of 5–7 Bar and a flow rate of 250–700 LPM. Also, the ratio of flow rates between oxygen gas and hydrogen gas is set such that oxygen:hydrogen is 1:2.0–2.6 (as converted to the standard state), which provides the optimum combustion efficiency. When the ratio of hydrogen relative to oxygen is below 2.0, the amount of unreacted oxygen increases, resulting in oxides being produced in the coating that cause deterioration in properties of the coating. Also, when the ratio of hydrogen to oxygen exceeds 2.6, the amount of unreacted hydrogen increases, resulting in an increase in cost.

In the present invention, the spraying distance at the time of thermal spray coating (distance between the thermal spray coating gun 1 and the base material to be thermal spray coated) is set at 170–350 mm. The reason is that in the case where the distance is less than 170 mm, the powder is not fully accelerated and heated. On the other hand, in the case where the distance exceeds 350 mm, the temperature and the speed of the powder which was accelerated and heated are lowered, resulting in a reduction of the adhesion strength between the base material and the powder particles and of that among particles, which is not desirable.

In addition, concerning the surface of the base material 100 to be thermal spray coated, it is necessary to remove scale from a part or the whole surface of the base material to perform preliminary cleaning and surface roughening, before forming the coating in order to enlarge the adhesion surface and maintain the adhesion strength with the coating 102 at high level.

This surface roughening can be suitably conducted by a grit blast treatment, which is carried out by blasting grit of such materials as SiC or alumina, onto the surface of the base material to be thermal spray coated with a pressure of about 0.5 MPa. The surface of the base material after the surface roughening preferably has an uneven surface formed having a surface roughness of $\mu$Rz=10–60, and more preferably of 15–40. This unevenness increases the contact area of the coating and the base material, strengthening the anchoring effect, that is, the mechanical bonding. If the surface roughness is below 10 $\mu$Rz, the anchoring effect is insufficient and thus the adhesion is lowered. On the other hand, if the surface roughness exceeds 60 $\mu$Rz, the surface roughness of the coating also becomes so rough as to require increased finishing work at a later stage, which is not efficient.

It is desirable that a thermal spray coating is carried out after performing such blast treatment and after heating the base material to 50–150° C. Heating to 50° C. or higher is necessary for preventing a dew condensation and increasing the adhesion. Also, suppressing the heating of the base material to 150° C. or below is necessary to prevent thermal deformation and strength deterioration of the base material. Further, it is necessary to control the temperature of the coating and the base material during the thermal spray coating operation to 200° C. or below, preferably to 150° C. or below in order to prevent the oxidation of the coating.

The thickness of the coating is preferably 0.02 mm or thicker for the securing abrasion resistance effect, and 0.5 mm or thinner for prevention of peel-off during the thermal spray coating and peel-off due to thermal stress during sliding. Also, the surface roughness after the thermal spray coating is preferably finished to Ra=0.4–6.0 S. Ra exceeding 6.0 S leads to the impairing of scuff resistance, whereas Ra below 0.4 S leads to a cost increase.

Examples of the present invention will be explained in further detail.

EXAMPLE 1

As the powder material for thermal spray coating, a mixed powder was prepared and used, which comprised 90% in volume of Cu based lead bronze alloy powder having the composition as shown in Table 1 below and 10% in volume of Al based alloy powder having the composition as shown in Table 1.

As the base material to be thermal spray coated, a swash plate having an outer diameter of 100 mm×inner diameter of 50 mm×thickness of 6 mm, for an air compressor pump was used. The material of the swash plate was SS41 (structural steel, Japanese Industrial Standards).

First, a grit blast treatment was performed as a preliminary treatment, by blowing alumina grit (particle size #20) against the surface of the swash plate with a pressure of 0.5 MPa. The surface roughness of the swash plate became $\mu$Rd=45–50 with this preliminary treatment.

Next, a preliminary heating was done using the thermal spray coating gun 1 shown in FIG. 1. At this time, the thermal spray coating gun 1 was operated in such a manner that only the flame was injected under the fusion coating condition mentioned below, but without the thermal spray coating material powder supplied. The thermal spray coating distance was maintained at 300 mm. The swash plate was heated to 100° C. to remove moisture, water and steam off the surface thereof.

Then, a coating was formed on the swash plate by using the thermal spray coating gun 1 under the following spray coating condition.

Thermal Spray Coating Condition

Combustion gas

Oxygen:pressure=11 Bar, flow rate=300 SLM;

Propane gas:pressure=7 Bar, flow rate=65 SLM; and

Air:pressure=6 Bar, flow rate=400 SLM

Here, "SLM" means the flow rate (liter/minute (LPM)) of gas as converted to the standard condition.

Flame temperature 2600° C.

Flame speed 1400 m/second

Thermal spray coating distance 200 mm

Amount of thermal spray coating material powder supplied 75 g/minute

TABLE 1

| Cu based lead bronze alloy (Particle diameter: 10–60$\mu$m) | | | | | |
|---|---|---|---|---|---|
| Component | Cu | Sn | Pb | Zn | Others (Fe, Sb, Si) |
| wt % | 80.1 | 10.2 | 8.4 | 0.6 | 0.7 |
| Al based lead bronze alloy (Particle diameter: 10–45$\mu$m) | | | | | |
| Component | Al | Si | Cu | Mg | Others (Fe, Zn, Mn) |
| wt % | 84.3 | 11.3 | 3.6 | 0.5 | 0.3 |

The thickness of the thermal spray coating formed on the surface of the swash plate was 0.23 mm. The surface of the coating was finished by buffing after machining so as to have a coating thickness of 0.15 mm and a surface roughness of Ra=0.6–0.8 S. No void or porosity having 0.01 mm diameter or larger was found on the finished surface. Also, the results of SEM observation and EPMA surface analysis revealed that the amount of lead which reacted with oxygen to become lead oxides, such as PbO, was small.

The swash plate having the thermal coating prepared as mentioned above was used to carry out a single item frictional abrasion test by pushing a shoe made of SUJ2 against the surface of the swash plate with a surface pressure or bearing pressure of 10 MPa and at the same time rotating the swash plate with a peripheral speed of 1 m/second. Also, as a comparative example, a conventional swash plate which was Sn-plated (plating thickness of 0.01 mm) on its surface was used to perform a single item frictional abrasion test under the same conditions. As a result, the conventional example with Sn-plating was worn with the maximum depth of wear of 0.01 mm or deeper and exposed the substrate SS41. In comparison, abrasion loss on the surface of the swash plate made by the present invention was 6 $\mu$m. Thus, it was revealed that the latter had better abrasion resistance, scuff resistance and pressure resistance.

EXAMPLES 2–5

Comparative Examples 1–5

As the thermal spray coating material powder, a mixed powder was prepared and used, which contains Cu based lead bronze alloy (A) having the composition as shown in Tables 2(a) and 2(b) and Al or Al based alloy (B) having the composition as shown in Tables 2(a) or 2(b) in the mixing ratio as shown in the tables.

As the base material to be thermal spray coated, ring shaped test pieces for the frictional abrasion test which were made of S15C (Japanese Industrial Standards) and had dimensions of an outer diameter of 120 mm×inner diameter of 60 mm×thickness of 5.5 mm, and disc shaped test pieces for the pressure resistance test which were made of SS41 (Japanese Industrial Standards) and had dimensions of diameter of 30 mm×height of 25 mm, were used.

First as a preliminary treatment, a grit blast treatment was performed by blasting alumina grit (particle size #30) onto the surfaces of these test pieces with a pressure of 0.4 MPa. The surface roughness of the test pieces was $\mu$Rz=25–35 after the preliminary treatment.

Next, a preheating treatment was conducted using the thermal spray coating gun 1 shown in FIG. 1. At this time, the spray coating gun 1 was operated in such a manner that only the flame was injected under the thermal spray coating condition shown below, but the thermal spray coating material powder was not supplied. The thermal spray coating distance was maintained at 300 mm. The test pieces were heated to 100° C. to remove moisture, water and steam off the surfaces thereof.

Then, a coating was formed on each test piece using the thermal spray coating gun 1 under the thermal spray coating condition mentioned below.

Thermal Spray Coating Condition

Combustion gas

Oxygen:pressure=12 Bar, flow rate=330 SLM;

Propylene gas:pressure=6.5 Bar, flow rate=75 SLM; and

Air:pressure=7 Bar, flow rate=390 SLM

Here, "SLM" means the flow rate (liter/minute (LPM)) converted to the standard state.

Flame temperature 2700° C.

Flame speed 1450 m/second

Thermal spray coating distance 200 mm

Amount of thermal spray coating material powder supplied 85 g/minute

TABLE 2-a

| | Mixing ratio (Volume %) | A: Cu based lead bronze alloy B: Al or Al based alloy | | | | | |
|---|---|---|---|---|---|---|---|
| Example 2 | A:B = 70:30 | A | Component | Cu | Sn | Pb | Zn | Others (Fe, Si, Sb) |
| | | | Weight % | 78.6 | 9.5 | 10.8 | 0.7 | 0.4 |
| | | B | Component | Al | Si | Cu | Mg | Others (Fe, Zn, Mn) |
| | | | Weight % | 85.0 | 11.5 | 2.5 | 0.7 | 0.3 |
| Example 3 | A:B = 90:10 | A | Component | Cu | Sn | Pb | Zn | Others (Fe, Si, Sb) |
| | | | Weight % | 88.6 | 5.9 | 4.4 | 0.4 | 0.7 |
| | | B | Component | Al | Si | Cu | Mg | Others (Fe, Zn, Mn) |
| | | | Weight % | 66.7 | 28.2 | 2.2 | 1.5 | 0.4 |
| Example 4 | A:B = 95:5 | A | Component | Cu | Sn | Pb | Zn | Others (Fe, Si, Sb) |
| | | | Weight % | 78.3 | 9.8 | 10.9 | 0.5 | 0.5 |
| | | B | Component | Al | Si | Cu | Mg | Others (Fe, Zn, Mn) |
| | | | Weight % | 78.6 | 14.4 | 5.5 | 1.2 | 0.3 |
| Example 5 | A:B = 97:3 | A | Component | Cu | Sn | Pb | Zn | Others (Fe, Si, Sb) |
| | | | Weight % | 78.3 | 10.9 | 9.8 | 0.5 | 0.5 |
| | | B | Component | Al | Si | Cu | Mg | Others (Fe, Zn, Mn) |
| | | | Weight % | 98.8 | 0.25 | 0.4 | 0.05 | 0.5 |

TABLE 2-b

| | Mixing ratio (Volume %) | A: Cu based lead bronze alloy B: Al or Al based alloy | | | | | |
|---|---|---|---|---|---|---|---|
| Comparative Example 1 | A:B = 50:50 | A | Component | Cu | Sn | Pb | Zn | Others (Fe, Si, Sb) |
| | | | Weight % | 78.3 | 10.9 | 9.8 | 0.5 | 0.5 |
| | | B | Component | Al | Si | Cu | Mg | Others (Fe, Zn, Mn) |
| | | | Weight % | 98.8 | 0.25 | 0.4 | 0.05 | 0.5 |
| Comparative Example 2 | A:B = 80:20 | A | Component | Cu | Sn | Pb | Zn | Others (Fe, Si, Sb) |
| | | | Weight % | 92.1 | 3.3 | 3.1 | 0.5 | 1.0 |
| | | B | Component | Al | Si | Cu | Mg | Others (Fe, Zn, Mn) |
| | | | Weight % | 84.5 | 10.9 | 3.5 | 0.8 | 0.3 |

TABLE 2-b-continued

| | Mixing ratio (Volume %) | A: Cu based lead bronze alloy B: Al or Al based alloy | | | | | | |
|---|---|---|---|---|---|---|---|---|
| Comparative Example 3 | A:B = 60:40 | A | Component | Cu | Sn | Pb | Zn | Others (Fe, Si, Sb) |
| | | | Weight % | 84.6 | 7.1 | 7.0 | 0.4 | 0.9 |
| | | B | Component | Al | Si | Cu | Mg | Others (Fe, Zn, Mn) |
| | | | Weight % | 68.0 | 16.9 | 7.0 | 7.5 | 0.6 |
| Comparative Example 4 | A:B = 40:60 | A | Component | Cu | Sn | Pb | Zn | Others (Fe, Si, Sb) |
| | | B | Weight % | 79.8 | 9.2 | 9.3 | 0.6 | 1.1 |
| | | | Component | Al | Si | Cu | Mg | Others (Fe, Zn, Mn) |
| | | | Weight % | 83.7 | 10.5 | 4.9 | 0.1 | 0.8 |
| Comparative Example 4 | A = 0 B = 100 | B | Component | Al | Si | Cu | Mg | Others (Fe, Zn, Mn) |
| | | | Weight % | 89.8 | 3.6 | 3.3 | 2.6 | 0.7 |

The thickness of the thermal spray coating of each test piece obtained was 0.15 mm in the ring shape test piece for the frictional abrasion test, and 0.5 mm in the disc shape test piece for the pressure resistance test. The surface of the coating of each test piece was then buffed after machining and finished to produce a coating thickness of 0.10 mm (test piece for frictional abrasion test) and 0.45 mm (test piece for pressure resistance test), and at the same time a surface roughness of Ra=0.6–0.8 S.

The disc shape test pieces for the pressure resistance test each having a coating made as mentioned above were used and then compressed by a universal testing machine for measuring the pressure resistance at which the coating was sheared to peel off the base material. The results of the measuring are shown in FIG. 2.

Similarly, the ring shape test pieces for the frictional abrasion test each having a coating made as mentioned above were used to measure an abrasion loss of the coating (ring) by pressing the surface of the test piece with a surface pressure of 220 MPa, by a block made of SUJ2 (Japanese Industrial Standards), and at the same time rotating the test piece with a peripheral speed of 20 m/second. The results are shown in FIG. 3.

Figure 4:
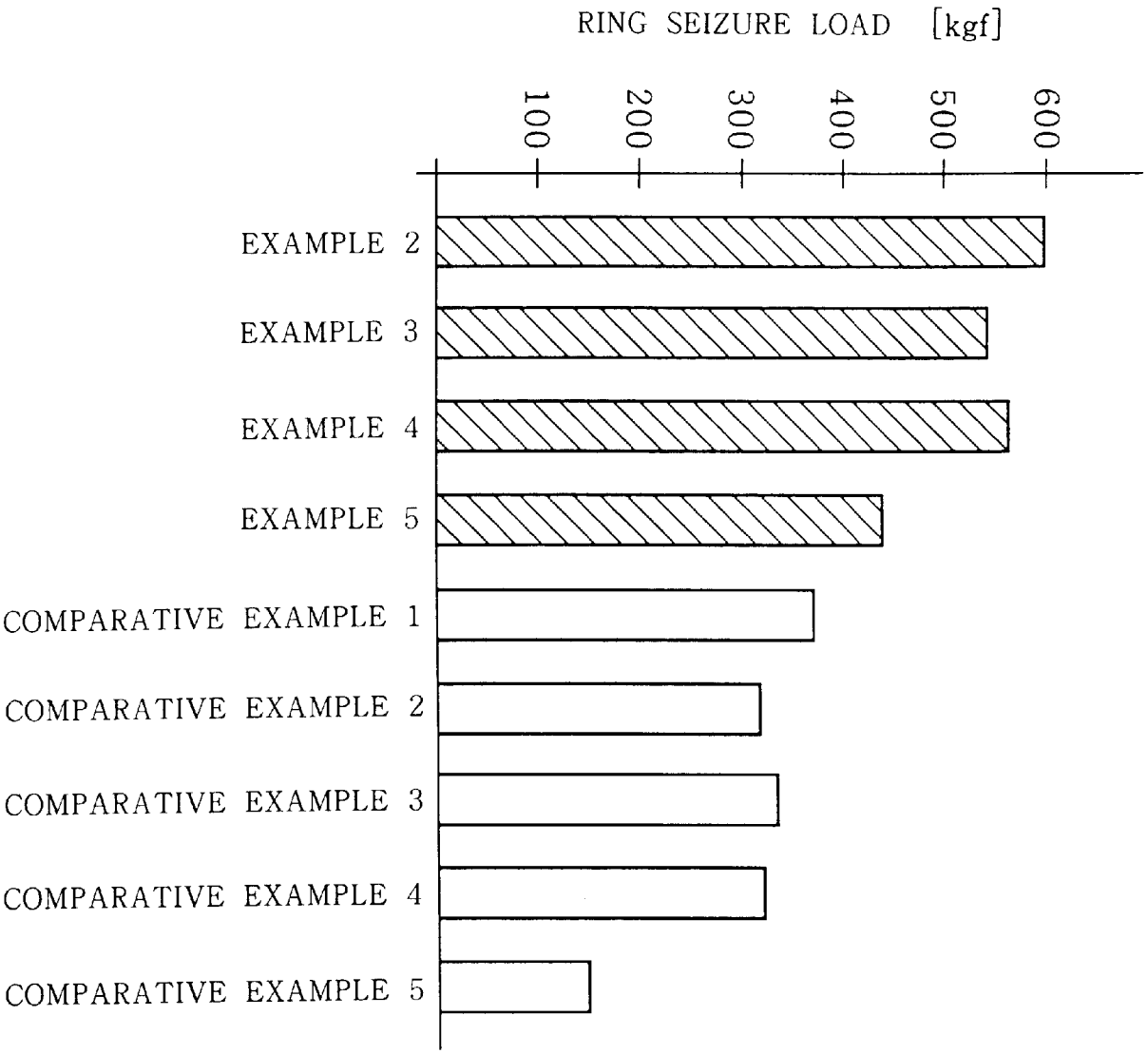
FIG. 4 is a drawing showing seizure load of the thermal spray coatings obtained by the high speed thermal spray coating method according to the present invention and that of the thermal spray coatings obtained by comparative examples.

Further, a shoe made of SUJ2 was pressed with a surface pressure of 220 MPa and simultaneously rotated with a peripheral speed of 20 m/second and a load until a seizure took place which was then measured. The results are shown in FIG. 4. Also, amounts of PbO and $PbO_2$ produced on the sectional tissue of each test piece was measured by surface analysis with EPMA, revealing that the area where lead oxides were formed was smaller than that in the coating having only the Cu based lead bronze alloy powder without addition of the Al powder or Al based alloy powder.

Figure 2:
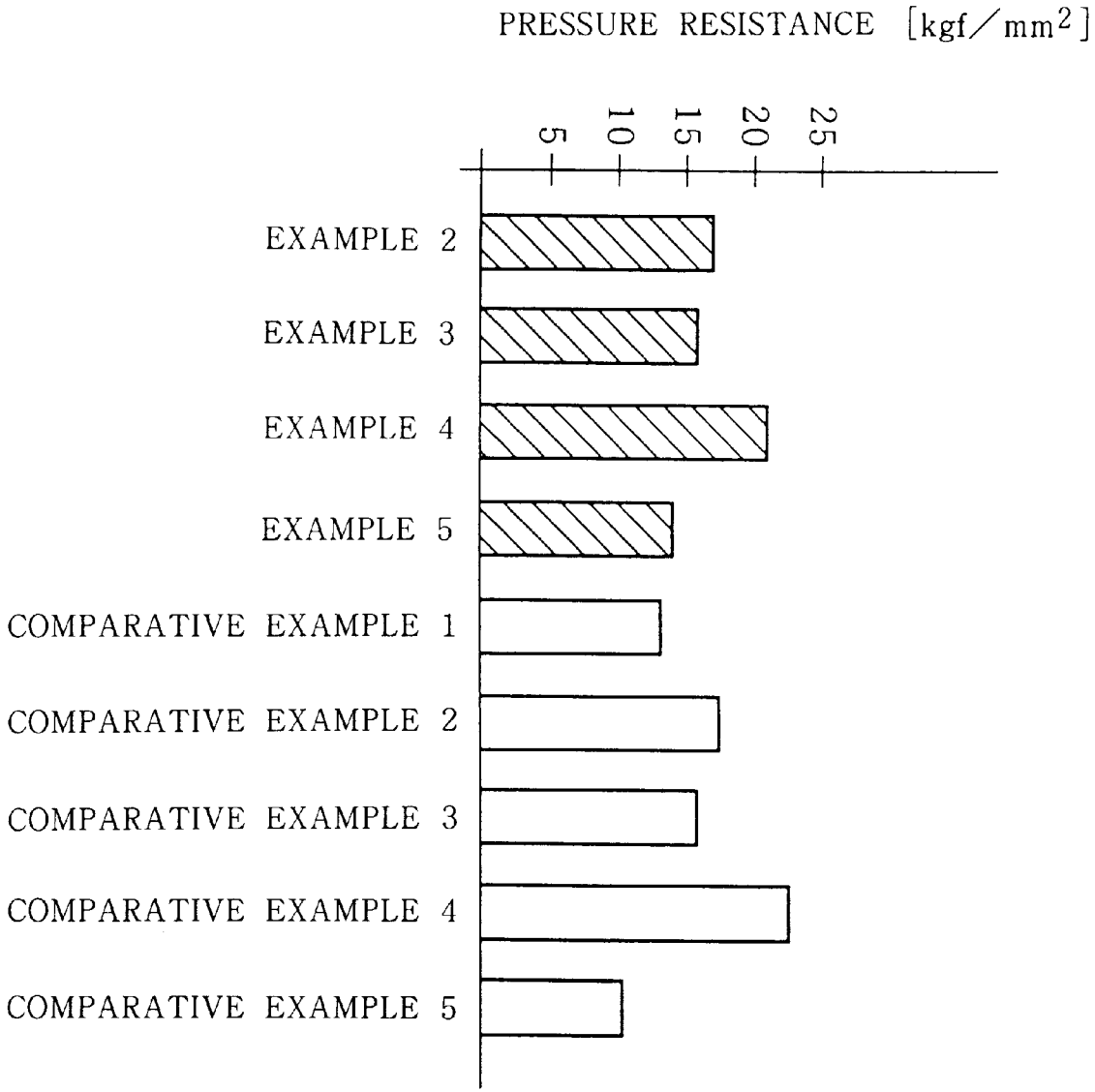
FIG. 2 is a drawing showing pressure resistance of the thermal spray coatings obtained by the high speed thermal spray coating method according to the present invention and that of the thermal spray coatings obtained by comparative examples.
Figure 3:
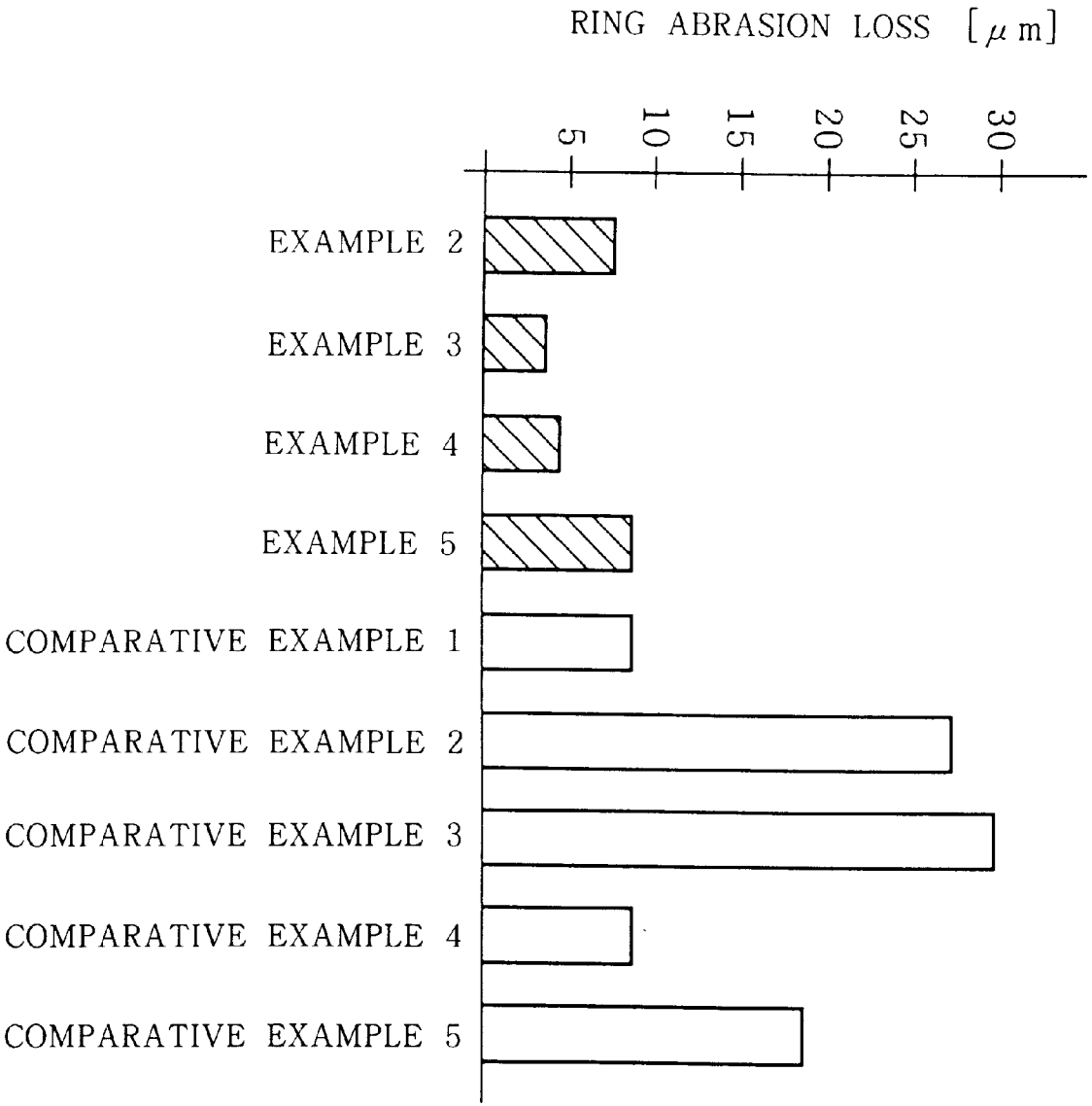
FIG. 3 is a drawing showing abrasion resistance of the thermal spray coatings obtained by the high speed thermal spray coating method according to the present invention and that of the thermal spray coatings obtained by comparative examples.

In appraising the pressure resistance, abrasion resistance and scuff resistance from the results shown in FIG. 2–FIG. 4, and it was revealed that the test pieces having the coatings shown in Examples 2, 3, 4, 5 made according to the invention were superior to those in Comparative Examples 1–5.

As has been explained above, since the high speed thermal spray coating method according to the present invention is constructed such that a mixed powder is used as thermal spray coating material powder, where the mixed powder contains:

(A) 98–70% in volume of Cu based lead bronze alloy powder, and (B) 2–30% in volume of Al powder or Al based alloy powder, it can achieve a number of effects such as:

(1) Coated layers which have satisfactory abrasion resistance, scuff resistance and pressure resistance, under high speed rotation, high load and non-lubricant conditions can be thermal spray coated on the surface of the base material to be thermal spray coated at a high speed and at the same time in an easy manner;

(2) Formation of lead oxides in the thermal spray coating is restrained, therefore a satisfactory coating can be formed, which is free from peel-off at the time of machining and capable of being soundly machine-finished without voids, and has good adhesion; and (3) Especially, a coating with excellent lubricity and abrasion resistance can be formed on a portion of the surface or the entire surface of a swash plate for an air compressor pump made of Al alloy, cast iron or steel based alloy.

We claim:

1. A high speed thermal spray coating method comprising providing a high speed flame from a combustion gas, and spraying a thermal spray coating material powder with said high speed flame onto a surface of a base material to form a coating on the surface of the base material, wherein said thermal spray coating material powder is a mixed powder comprising:

(A) 98–70% by volume of Cu based lead bronze alloy powder, and (B) 2–30% by volume of Al powder or Al based alloy powder.

2. A high speed thermal spray coating method according to claim 1, wherein said Cu based lead bronze alloy powder comprises a Cu based lead bronze alloy containing 77–89% Cu by weight, 4–11% Sn by weight, 4–11% Pb by weight and the balance being impurities of 1% or less by weight, said Al powder comprises Al containing less than 1.5% by weight of impurities, and said Al based alloy powder comprises Al based alloy containing 65–95% Al by weight, 4–30% Si by weight, 0.5–6% by weight, and 0.3–12% Mg by weight.

3. A high speed thermal spray coating method according to claim 1 or claim 2, wherein each of said Cu based lead bronze alloy powder, said Al powder and said Al based alloy powder has a particle diameter of 10–75 $\mu$m.

4. A high speed thermal spray coating method according to claim 3, further comprising subjecting said base material to a grit blast treatment on the surface of said base material so as to obtain a surface roughness of $\mu$ Rz=10–60 microns, and heating said grit blast treated base material to 50–150° C., before spraying said thermal spray coating material powder onto the surface of said base material, whereby spraying said thermal spray coating material powder forms a coating having a thickness of 0.2–0.5 mm on the surface of said base material.

5. A high speed thermal spray coating method according to claim 3, wherein said combustion gas is one of the mixed gases comprising oxygen/propane, oxygen/propylene, oxygen/natural gas, oxygen/ethylene, oxygen/kerosene and oxygen/hydrogen to generate a high speed flame having a flame speed of 1000–2500 m/second and a flame temperature of 2200–3000° C., the thermal spray coating distance is maintained at 170–350 mm, and the temperature of the coating and the base material during thermal spray coating is maintained at 200° C. or below.

6. A high speed thermal spray coating method according to claim 3 wherein said coating on the surface of the base material is finished to have a surface roughness of Ra=0.4–6.0 microns.

7. A high speed thermal spray coating method according to claim 3 wherein said base material is a swash plate for an air compressor pump comprising Al alloy, cast iron or steel based alloy.

8. A high speed thermal spray coating method according to claim 1 or 2, further comprising subiecting said base material to a grit blast treatment on the surface of said base material so as to obtain a surface roughness of $\mu$ Rz=10–60 microns, and heating said grit blast treated base material to 50–150° C., before spraying said thermal spray coating material powder onto the surface of said base material, whereby spraying said thermal spray coating material powder forms a coating having a thickness of 0.2–0.5 mm on the surface of said base material.

9. A high speed thermal spray coating method according to claim 8, wherein said combustion gas is one of the mixed gases comprising oxygen/propane, oxygen/propylene, oxygen/natural gas, oxygen/ethylene, oxygen/kerosene and oxygen/hydrogen to generate a high speed flame having a flame speed of 1000–2500 m/second and a flame temperature of 2200–3000° C., the thermal spray coating distance is maintained at 170–350 mm, and the temperature of the coating and the base material during thermal spray coating is maintained at 200° C. or below.

10. A high speed thermal spray coating method according to claim 8 wherein said coating on the surface of the base material is finished to have a surface roughness of Ra=0.4–6.0 microns.

11. A high speed thermal spray coating method according to claim 8 wherein said base material is a swash plate for an air compressor pump comprising Al alloy, cast iron or steel based alloy.

12. A high speed thermal spray coating method according to claim 1 or 2, wherein said combustion gas is one of the mixed gases comprising oxygen/propane, oxygen/propylene, oxygen/natural gas, oxygen/ethylene, oxygen/kerosene and oxygen/hydrogen to generate a high speed flame having a flame speed of 1000–2500 m/second and a flame temperature of 2200–3000° C., the thermal spray coating distance is maintained at 170–350 mm, and the temperature of the coating and the base material during thermal spray coating is maintained at 200° C. or below.

13. A high speed thermal spray coating method according to claim 12 wherein said coating on the surface of the base material is finished to have a surface roughness of Ra=0.4–6.0 microns.

14. A high speed thermal spray coating method according to claim 12 wherein said base material is a swash plate for an air compressor pump comprising Al alloy, cast iron or steel based alloy.

15. A high speed thermal spray coating method according to claims 1 or 2, wherein said coating on the surface of the base material is finished to have a surface roughness of Ra=0.4–6.0 microns.

16. A high speed thermal spray coating method according to claim 15 wherein said base material is a swash plate for an air compressor pump comprising Al alloy, cast iron or steel based alloy.

17. A high speed thermal spray coating method according to claim 1 or 2, wherein said base material is a swash plate for an air compressor pump comprising Al alloy, cast iron or steel based alloy.

* * * * *

UNITED STATES PATENT AND TRADEMARK OFFICE

CERTIFICATE OF CORRECTION

PATENT NO. : 5,958,522

DATED : Sept. 28, 1999

INVENTOR(S) : Nakagawa *et al.*

It is certified that error appears in the above-identified patent and that said Letters Patent is hereby corrected as shown below:

Claim 2, column 12, line 51, after "0.5-6%" insert -- Cu --.

Signed and Sealed this

Twenty-third Day of May, 2000

*Attest:*

Q. TODD DICKINSON

*Attesting Officer*

*Director of Patents and Trademarks*